US008109795B2

(12) United States Patent
Lin et al.

(10) Patent No.: US 8,109,795 B2
(45) Date of Patent: Feb. 7, 2012

(54) USB/ESATA COMBO RECEPTABLE FEATURED WITH GROUND LAYER RETARDING INTERFACES THEREBETWEEN

(75) Inventors: Chih-Nan Lin, Tu-Cheng (TW); Kuo-Chun Hsu, Tu-Cheng (TW); Hung-Chi Yu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/763,225

(22) Filed: Apr. 20, 2010

(65) Prior Publication Data

US 2010/0267261 A1 Oct. 21, 2010

(30) Foreign Application Priority Data

Apr. 20, 2009 (TW) ..... 98206547 U

(51) Int. Cl.
*H01R 24/00* (2006.01)

(52) U.S. Cl. ..... 439/660

(58) Field of Classification Search ..... 439/660, 439/79, 607.11, 607.13, 607.04, 607.23
See application file for complete search history.

(56) References Cited

U.S. PATENT DOCUMENTS

| | | | | |
|---|---|---|---|---|
| 7,077,668 | B2 * | 7/2006 | Lapidot et al. | 439/108 |
| 7,371,116 | B2 | 5/2008 | Chiang | |
| 7,758,379 | B2 * | 7/2010 | Chen | 439/607.11 |

* cited by examiner

*Primary Examiner* — Alexander Gilman
(74) *Attorney, Agent, or Firm* — Andrew C. Cheng; Wei Te Chung; Ming Chieh Chang

(57) ABSTRACT

An electrical connector includes an insulative housing defining a mating cavity, two parallel and stacked mating portions respectively forwards extending into the mating cavity, sets of contact retained in the housing and a grounding member retained in the housing. The first mating portion defines thereon a first surface; the second mating portion spaces from the first mating portion and defines thereon a second surface opposite to the first surface. The sets of contact include a first set of contacts each defining a contacting section exposed upon the first surface and a second set of contacts each defining a deflectable cantilevered beam accessible from the second face. The grounding member is disposed between the first and second mating portions to reduce the cross-talk between the first and second sets of contacts.

7 Claims, 4 Drawing Sheets

USB/ESATA COMBO RECEPTABLE FEATURED WITH GROUND LAYER RETARDING INTERFACES THEREBETWEEN

CROSS-REFERENCE TO RELATED APPLICATIONS

This application is related to U.S. patent application Ser. No. 12/630,725, filed on Dec. 3, 2009 and entitled "RECEPTACLE CONNECTOR HAVING SHUTTLE TO SELECTIVELY SWITCH TO DIFFERENT INTERFACES"; U.S. patent application Ser. No. 12/701,607, filed on Feb. 8, 2010 and entitled "ELECTRICAL CONNECTOR FEATURED USB/eSATA INTERFACES"; and U.S. patent application Ser. No. 12/702,293 filed on Feb. 9, 2010 and entitled "ELECTRICAL CONNECTOR FEATURED USB/eSATA INTERFACES INCORPORATED WITH ADDITIONAL POWER CONTACT"; all of which have the same assignee as the present invention.

BACKGROUND OF THE INVENTION

1. Field of the Invention

The present invention relates to an electrical connector, and more particularly to an electrical connector compatible to standards of Universal Serial Bus (USB) and External Serial Advanced Technology Attachment (eSATA) protocols and having a grounding member which is disposed between the USB contact set and the eSATA contact set to improve the cross-talk between the two contact sets.

2. Description of the Related Art

U.S. Pat. No. 7,371,116 issued to Chiang on May 13, 2008 discloses a connector socket compatible to external serial ATA (eSATA) and universal serial bus (USB) connectors has a casing, an eSATA contact set and a USB contact set. The casing has a cavity defined in the casing, an inner rear surface and a contact seat formed on and extending forward from the inner rear surface. The eSATA contact set is mounted on the contact seat and has multiple eSATA contacts being conductive and mounted on the contact seat. The USB contact set is mounted on the contact seat opposite to the eSATA contact set and has multiple USB contacts mounted thereon the contact seat. It can be readily seen from the disclosure of the Chiang '116 patent that cross-talk will be produced between the eSATA contact set and the USB contact set, which may weaken the capability of the connector.

In addition, cross-talk is a concern in designing a high performance connector. Therefore, an improved electrical connector having lower cross-talk is highly desired.

SUMMARY OF THE INVENTION

An object of the present invention is to provide an electrical connector compatible to both standards of Universal Serial Bus (USB) and External Serial Advanced Technology Attachment (eSATA) protocols and having a first mating portion and a second mating portion with a grounding member disposed between the first and second mating portions.

In order to achieve the above-mentioned object, an electrical connector includes an insulative housing defining a mating cavity, two parallel and stacked mating portions respectively forwards extending into the mating cavity, sets of contact retained in the housing and a grounding member retained in the housing. The first mating portion defines thereon a first surface; the second mating portion spaces from the first mating portion and defines thereon a second surface opposite to the first surface. The sets of contact include a first set of contacts each defining a contacting section exposed upon the first surface and a second set of contacts each defining a deflectable cantilevered beam accessible from the second face. The grounding member is disposed between the first and second mating portions.

Other objects, advantages and novel features of the invention will become more apparent from the following detailed description of the present embodiment when taken in conjunction with the accompanying drawings.

DETAILED DESCRIPTION OF THE INVENTION

Figure 1:
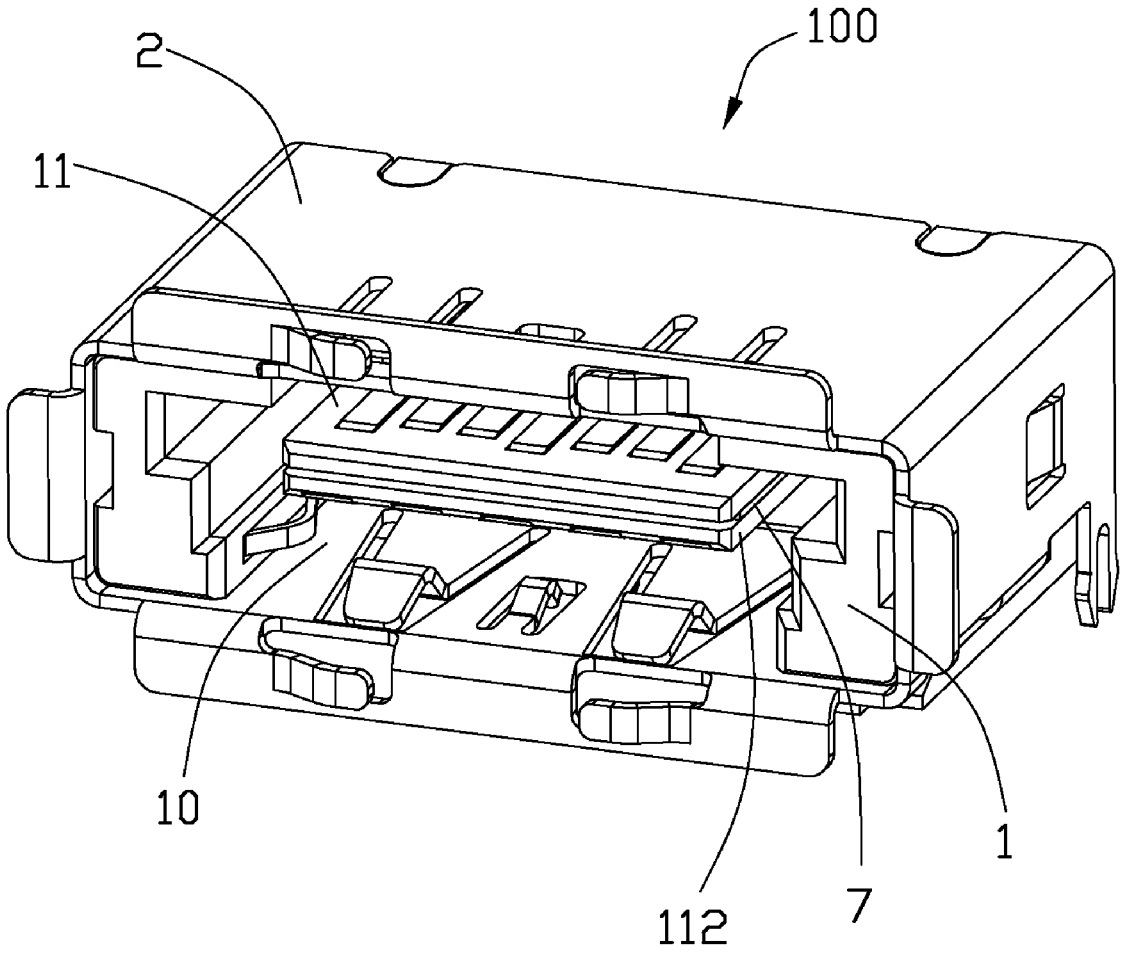
FIG. 1 is an assembled, perspective view of an electrical connector in accordance with the present invention.
Figure 2:
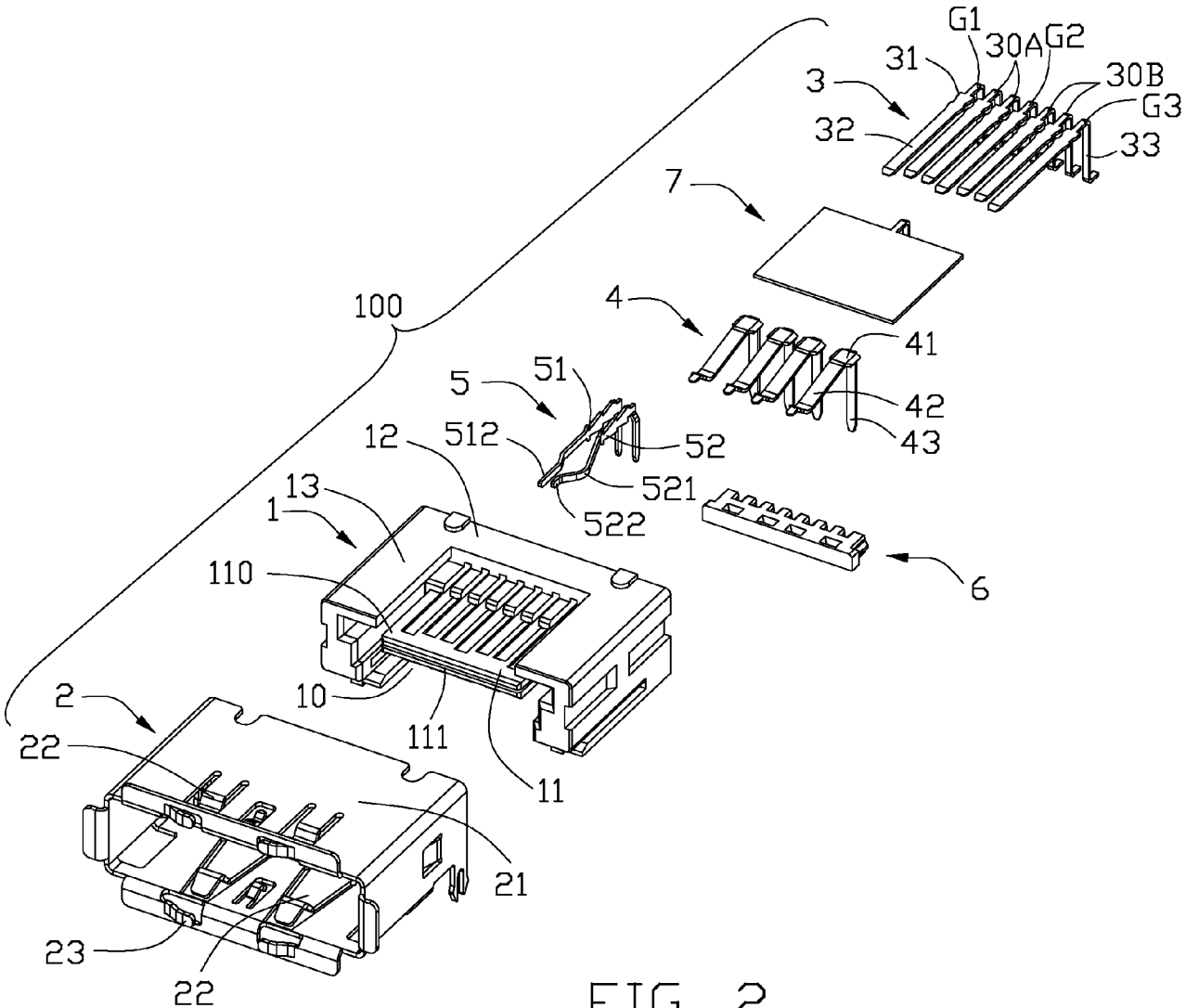
FIG. 2 is an exploded perspective view of the electrical connector shown in FIG. 1.
Figure 3:
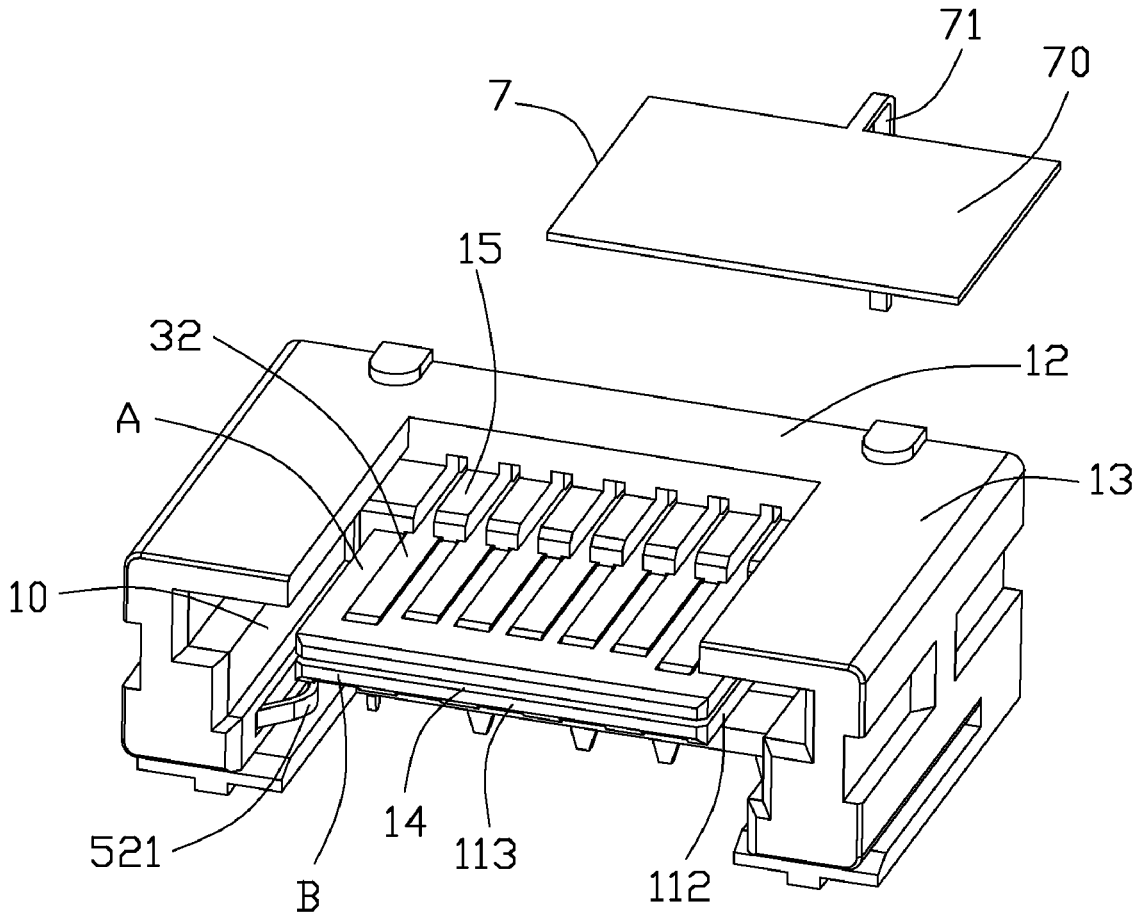
FIG. 3 is a perspective view of the electrical connector shown in FIG. 1 with the shell removed.
Figure 4:
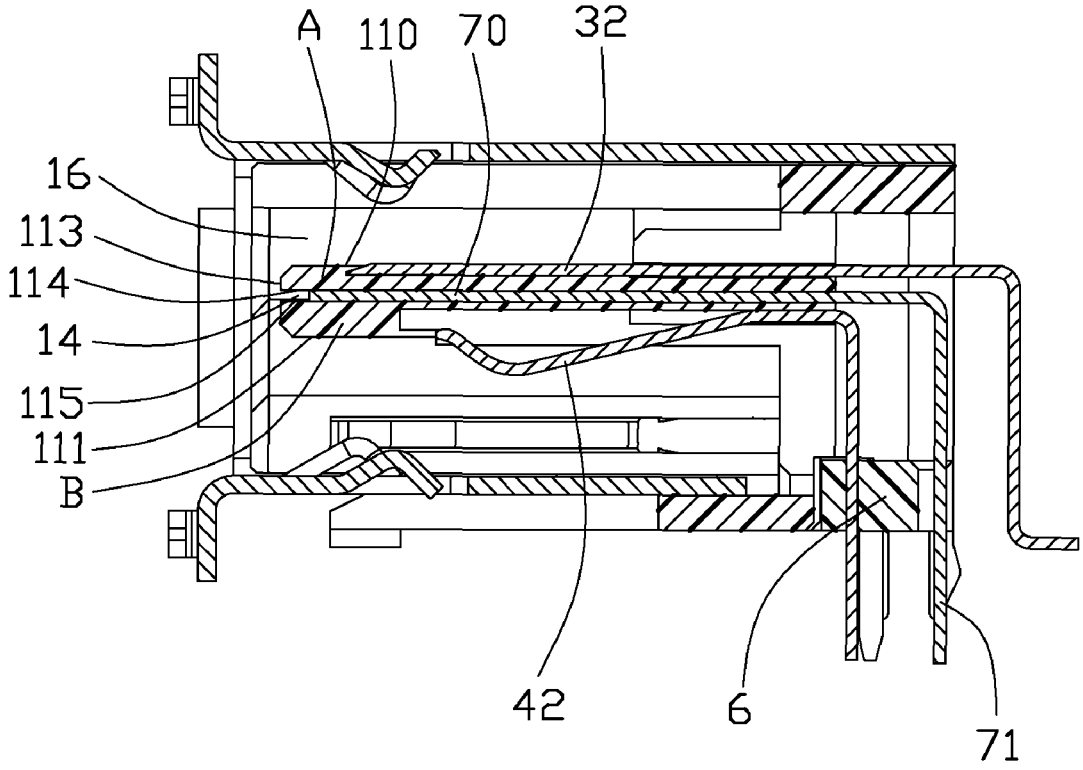
FIG. 4 is a cross sectional view of FIG. 1, showing the grounding member disposed between eSATA contacts and USB contacts.

Reference will now be made to the drawing figures to describe the preferred embodiment of the present invention in detail.

Referring to FIG. 1, disclosed here is an electrical connector 100 made in accordance with the present invention. The electrical connector 100, compatible to standards of Universal Serial Bus (USB) and External Serial Advanced Technology Attachment (eSATA) protocols, includes an insulative housing 1, a shielding shell 2 surrounding the housing 1, sets of contact retained to the housing 1 and a grounding member 7 disposed in the housing 1.

Referring to FIG. 1 to FIG. 4, the housing 1 defines a base portion 12, a pair of sidewalls 13 respectively extending forwards from two opposite ends of the base portion 12, a mating cavity 10 defined by the pair of sidewalls 13 and the base portion 12 commonly and two mating portions A, B spaced from each other and respectively extending forwards from the base portion 12 and into the mating cavity 10 along a mating direction. The mating cavity 10 runs through a front end of the housing 1. The first and second mating portions A, B spaced away from said opposite sidewalls 13 and stacked with each other in a vertical direction. The first mating portion A is parallel to the second mating portion B and has thereon an upper/first surface 110 and a third surface 114 opposite to the first surface 110, the second mating portion B defines a lower/second surface 111 and a fourth surface 115 facing to the third surface 114. The first mating portion A defines a first interface, and the second mating portion B defines a second interface individually spaced from each other. Although the first and second mating portions A, B are closely arranged to each other, but they are functionally and physically distinct from each other.

The first mating portion A unites with the second mating portion B to define a tongue portion 11 of the electrical connector 100, and the first surface 110 of the mating portion A is provided as a top surface of the tongue portion 11, and the second surface 111 of the mating portion B is provided as a bottom surface of tongue portion 11. The tongue portion 11 defines two opposite side surfaces 112 facing to the sidewalls 13, a front face 113 connecting with the side surfaces 112 and the first and second surfaces 110, 111, and a receiving slot 14 recessed forwards and sideward from a rear face of the base portion 12 to run through the side surfaces 112 and the front surface 113 of the tongue portion 11 thereof. The receiving slot 14 is disposed between the third and fourth surfaces 114, 115. Stand-off portions 15 are formed at a joint of the first surface 110 of the tongue portion 11 and the base portion 12 to increase the rigidity of the tongue portion 11.

The contacts are grouped into a first set of contacts 3, totally seven eSATA contacts are included for connecting with a first complementary connector/an eSATA plug (not shown), a second set of contacts 4, totally four USB contacts are included for connecting with a second complementary connector/a USB plug (not shown), and a detecting pairs 5. The first set of contacts 3 includes two pairs of differential pairs 30A, 30B for signal transmission and three grounding contacts G1, G2 and G3 located alternatively at two opposite sides of the differential pairs 30A, 30B. The first set of contacts 3 is defined as an eSATA contact set, and the second set of contacts 4 is defined as a USB contact set.

The eSATA contacts of the first set of contacts 3 have similar configuration and each includes a retention section 31 retained in the base portion 12, a blade contacting section 32 extending forward from the retention section 31 and a leg section 33 bending downwards from the retention section 31. The contacting sections 32 are arranged on the first surface 110 of the first mating portion A along a traverse direction perpendicular to the mating direction, and the leg sections 33 extend out of the base portion 12 to connect with a printed circuit board (PCB).

The second set of contacts 4 each includes a retention section 41 retained in the base portion 12, a deflectable cantilevered beam 42 forwards extending from the retention section 41 into the mating cavity 10, and a leg section 43 bending downwards from the retention section 41. The deflectable cantilevered beam 42 is accessible from the second surface 111 of the second mating portion B. The cantilevered beams 42 are designated as USB 2.0 contacting sections.

The grounding member 7 defines a board-shaped main section 70 and a leg section 71 bending from a rear edge of the main section 70. The grounding member 7 is retained in tongue portion 11 with the main section 70 received in the receiving slot 14 and disposed between the first and second mating portions A, B, and the leg section 71 extends out of the housing 1. The main section 70 is sandwiched by the third and fourth surfaces 114, 115. The side edges of main section 70 expose on the corresponding side faces 112, and the front edge of the main section 70 is hidden in the receiving slot 14 without any portion extending beyond the front face 113. The main section 70 is disposed between the contacting portion 32 and the deflectable cantilevered beam 42 and spaced from both the contacting portion 32 and the deflectable cantilevered beam 42, which can reduce the cross-talk between the eSATA contact set 3 and the USB contact set 4, and further to provide an electrical connector 100 having low cross-talk.

The detecting pairs 5 is retained to the sidewall 13 and includes a contacting pin 51 and a movable pin 52. The movable pin 52 defines a projecting portion 521 projecting into the mating cavity 10 and a contacting portion 522 disposed at a free end of the projecting portion and further extending into the sidewall 13. The contacting pin 51 defines an abutting portion 512 facing to the contacting portion 522. The contacting portion 522 may move to contact the abutting portion 512 when the projecting portion 521 is driven by the USB plug inserted into the mating cavity 10. The shell 2 surrounds the housing 1 and defines an elastic piece 22 stamped from a top piece 21 and entering into the mating cavity 10 to latch the complementary connectors. The top piece 21 and a bottom piece 20 opposite to the top piece 21 each further defines an abutting piece 23 projecting forwards to contact with peripheral equipment. The leg sections 33, 43 and 71 run through a retaining member 6 to connect with the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector compatible to standards of Universal Serial Bus (USB) and External Serial Advanced Technology Attachment (eSATA) protocols, comprising:

an insulative housing defining a base portion, a pair of sidewalls respectively extending forwards from two opposite ends of the base portion and a tongue portion disposed between the sidewalls and defining thereon first and second surfaces opposite to each other;

an eSATA contact set comprising several contacts each defining a blade contacting section exposed upon the first surface and a leg section;

a USB contact set comprising several contacts each defining a deflectable cantilevered beam accessible from the second surface; and a grounding member retained in the tongue portion and disposed between the eSATA contact set and the USB contact set, and further spaced from the blade contacting sections and the deflectable cantilevered beams;

wherein the tongue portion defines two opposite side surfaces facing to the sidewalls, a front face connecting with the side surfaces and a receiving slot running through the side surfaces and the front face thereof to divide the tongue portion into first and second mating portions spaced from each other, and the grounding member defines a horizontal main section received in the receiving slot and disposed between the first and second mating portions;

wherein the grounding member also has a soldering leg perpendicularly extending downward from the main section for being mounted onto a printed circuit board on which the electrical connector is mounted.

2. The electrical connector as described in claim 1, wherein the main section is retained in the receiving slot without any portion extending beyond the front face and the corresponding side surfaces.

3. An electrical connector comprising:

an insulative housing defining a mating port with therein a forwardly extending mating tongue defining opposite first and second faces thereon;

a plurality of first contacts disposed in the housing and defining stiff contacting sections exposed upon the first face and first soldering legs extending out of the insulative housing;

a plurality of second contacts disposed in the housing and defining resilient contacting section exposed upon the second face and second soldering legs extending out of the insulative housing;

a grounding member embedded into the mating tongue between the first face and the second face with a grounding leg extending out of the insulative housing; wherein the housing defines a plurality of spaced standoffs formed on a rear region of the first face of the mating tongue, and the first contacts are respectively exposed in corresponding gaps between said spaced standoffs;

wherein said grounding leg extends downwardly and is located between the first soldering legs and second soldering legs along a front-to-rear direction.

4. The electrical connector as described in claim 3, wherein the grounding member is inserted into the mating tongue from a rear end of the insulative housing.

5. The electrical connector as described in claim 4, wherein a pair of switch terminals are arranged at a lateral side of the mating port and located under the mating tongue.

6. An electrical connector comprising:

an insulative housing defining a mating port with therein a forwardly extending mating tongue extending forwardly from a base along a mating direction and defining opposite first and second faces thereon in a vertical direction perpendicular to said mating direction;

a plurality of first contacts disposed in the housing and defining stiff contacting sections exposed upon the first face;

a plurality of second contacts disposed in the housing and defining resilient contacting section exposed upon the second face;

a grounding plate embedded into the mating tongue between the first face and the second face; wherein the housing defines a plurality of standoffs formed on a rear region of the first face of the mating tongue and rearwardly joined with the base and spaced from one another with gaps in a transverse direction perpendicular to both said mating direction and said vertical direction, and the first contacts are respectively exposed vertically in the corresponding gaps between said spaced standoffs.

7. The electrical connector as claimed in claim 6, wherein the grounding plate includes a tail extending downwardly beyond the housing in the vertical direction.

* * * * *